US008344255B2

(12) United States Patent
Wiekhorst et al.

(10) Patent No.: US 8,344,255 B2
(45) Date of Patent: Jan. 1, 2013

(54) CABLE WITH JACKET INCLUDING A SPACER

(75) Inventors: David Wiekhorst, Potter, NE (US); Spring Stutzman, Sidney, NE (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 178 days.

(21) Appl. No.: 12/689,836

(22) Filed: Jan. 19, 2010

(65) Prior Publication Data

US 2010/0181093 A1 Jul. 22, 2010

Related U.S. Application Data

(60) Provisional application No. 61/145,320, filed on Jan. 16, 2009.

(51) Int. Cl.
*H01B 7/00* (2006.01)

(52) U.S. Cl. ..... 174/113 R

(58) Field of Classification Search ..... 174/113 R, 174/113 C

See application file for complete search history.

(56) References Cited

U.S. PATENT DOCUMENTS

| | | | | |
|---|---|---|---|---|
| 504,397 | A | 9/1893 | Marsh | |
| 4,892,442 | A | 1/1990 | Shoffner | |
| 5,132,488 | A | 7/1992 | Tessier et al. | |
| 5,286,923 | A | 2/1994 | Prudhon et al. | |
| 5,796,046 | A | 8/1998 | Newmoyer et al. | |
| 5,821,467 | A | 10/1998 | O'Brien et al. | |
| 5,990,419 | A | 11/1999 | Bogese, II | |
| 6,566,607 | B1 * | 5/2003 | Walling | 174/113 R |
| 6,743,983 | B2 | 6/2004 | Wiekhorst et al. | |
| 7,049,519 | B2 | 5/2006 | Wiekhorst et al. | |
| 7,135,641 | B2 | 11/2006 | Clark | |
| 7,145,080 | B1 | 12/2006 | Boisvert et al. | |
| 7,205,479 | B2 | 4/2007 | Caveney | |
| 7,214,880 | B2 | 5/2007 | Wiekhorst et al. | |
| 7,214,884 | B2 | 5/2007 | Kenny et al. | |
| 7,238,886 | B2 | 7/2007 | Wiekhorst et al. | |
| 7,256,351 | B2 | 8/2007 | Dillon et al. | |
| 7,271,344 | B1 | 9/2007 | Stutzman et al. | |
| 7,317,163 | B2 | 1/2008 | Lique et al. | |
| 7,375,284 | B2 | 5/2008 | Stutzman et al. | |
| 8,030,571 | B2 * | 10/2011 | Vexler et al. | 174/110 R |
| 2005/0051355 | A1 | 3/2005 | Bricker et al. | |
| 2006/0032660 | A1 * | 2/2006 | Parke et al. | 174/113 R |
| 2006/0169479 | A1 * | 8/2006 | Dillon et al. | 174/113 R |
| 2007/0193769 | A1 * | 8/2007 | Clark et al. | 174/113 R |
| 2007/0209823 | A1 | 9/2007 | Vexler et al. | |
| 2008/0164049 | A1 | 7/2008 | Vexler et al. | |
| 2009/0071691 | A1 * | 3/2009 | Clark | 174/116 |

* cited by examiner

*Primary Examiner* — Chau Nguyen
(74) *Attorney, Agent, or Firm* — Merchant & Gould P.C.

(57) ABSTRACT

A multi-pair cable having a jacket, including a spacer integrally formed in the jacket. The spacer extends helically about the central axis of the cable. The spacer includes an inner projection that projects radially inward and an outer projection that projects radially outward from the main wall of the jacket. The jacket with the spacer reduces the occurrence of alien crosstalk between adjacent cables.

15 Claims, 5 Drawing Sheets

CABLE WITH JACKET INCLUDING A SPACER

CROSS REFERENCE TO RELATED APPLICATION

The present application claims the benefit of U.S. Provisional Patent Application Ser. No. 61/145,320, filed Jan. 16, 2009, which application is hereby incorporated by reference in its entirety.

TECHNICAL FIELD

The present disclosure relates generally to cables for use in the telecommunications industry, and various methods associated with such cables. More particularly, this disclosure relates to a telecommunications cable having a jacket.

BACKGROUND

Twisted pairs cables include at least one pair of insulated conductors twisted about one another to form a two conductor pair. A number of two conductor pairs can be twisted about each other to define a twisted pair core. A plastic jacket is typically extruded over a twisted pair core to maintain the configuration of the core, and to function as a protective layer. Such cables are commonly referred to as multi-pair cables.

The telecommunications industry is continuously striving to increase the speed and/or volume of signal transmissions through multi-pair cables. One problem that concerns the telecommunications industry is the increased occurrence of alien crosstalk associated with high-speed signal transmissions. In some applications, alien crosstalk problems are addressed by providing multi-pair cables having a layer of electrical shielding between the core of twisted pairs and the cable jacket. Such shielding however is expensive to manufacture; accordingly, unshielded twisted pair cables are more often used.

Without electrical shielding, and with the increase in signal frequencies associated with high-speed transmissions, alien crosstalk can be problematic. Undesired crosstalk in a cable is primarily a function of cable capacitance. As a cable produces more capacitance, the amount of crosstalk increases. Capacitance of a cable is dependent on two factors: 1) the center-to-center distance between the twisted pairs of adjacent cables, and 2) the overall dielectric constant of the cables.

SUMMARY

One aspect of the present disclosure relates to a cable comprising a core and a jacket. The core includes a plurality of twisted pairs. Each twisted pair includes two different insulated conductors twisted about one another. The jacket surrounds the core. The jacket includes a spacer integrally formed in the main wall of the jacket. The spacer includes an inner projection that projects radially inward and an outer projection that projects radially outward from the main wall of the jacket. The jacket with the spacer reduces the occurrence of alien crosstalk between adjacent cables.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Reference will now be made in detail to various features of the present disclosure that are illustrated in the accompanying drawings. Wherever possible, the same reference numbers will be used throughout the drawings to refer to the same or like parts.

FIGS. 1-8 illustrate embodiments of cables 10 having features that are examples of how inventive aspects in accordance with the principles of the present disclosure may be practiced. Preferred features are adapted for reducing alien crosstalk between adjacent cables 10.

Figure 1:
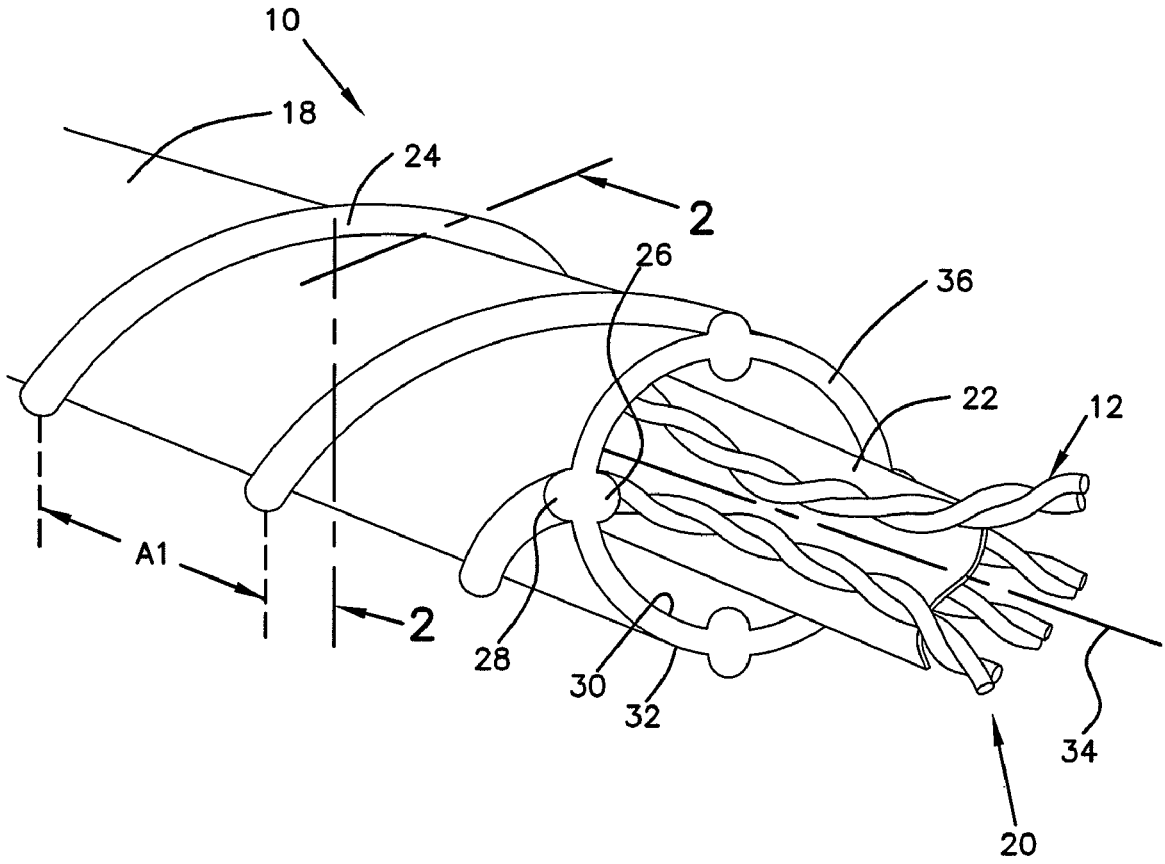
FIG. 1 is a perspective view of one embodiment of a cable according to the principles of the present disclosure.
Figure 2:
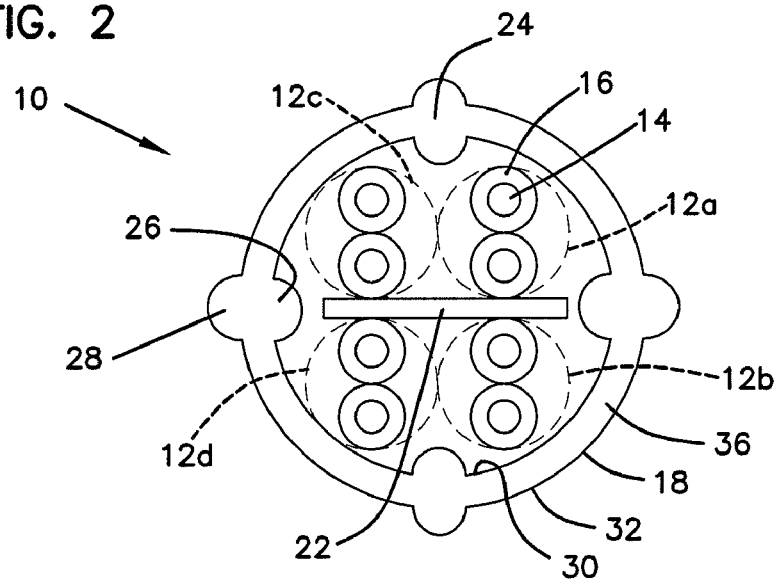
FIG. 2 is a cross-sectional view of the cable of FIG. 1, taken along line 2-2.

Referring to FIGS. 1, 2, and 5-7 a cable 10 in accordance with the principles disclosed is illustrated. The cable 10 includes a core 20 and a jacket 18. The core 20 includes a plurality of twisted pairs 12, each twisted pair 12 including first and second insulated conductors 14 twisted about one another. Each of the conductors 14 is surrounded by an insulating layer 16 (FIG. 2). In a preferred embodiment, the cable 10 includes four twisted pairs 12. The jacket 18 includes a main wall 36 that surrounds the core 20. The main wall 36 includes an inner surface 30 and an outer surface 32. The jacket 18 also includes a spacer 24 integrally formed in the main wall 36. The spacer 24 extends helically about the central axis 34. The spacer 24 includes an inner projection 26 that projects radially inwardly from the inner surface 30 of the main wall 36 toward the central axis 34. The inner projection 26 spaces the core 20 from the inner surface 30 of the main wall 36 such that an air gap is defined between the core 20 and the inner surface 30 of the main wall 36. The spacer 24 also includes an outer projection 28 that projects radially outwardly from the outer surface 32 of the main wall 36 away from the central axis 34. The outer projection 28 spaces adjacent cables 10 such that an air gap is defined between the adjacent cables 10.

The spacer 24 of the jacket 18 increases the distance between cores 20 of adjacent cables 10 without increasing the amount of jacket material utilized while increasing the amount of insulating air found around the jacket 18 lowering capacitance to reduce the occurrence of alien crosstalk between adjacent cables 10. Accordingly, the spacers 24 of the jacket 18 distance the core 20 of the twisted pairs 12 further from adjacent cables 10 than conventional arrangements. Ideally, the cores 20 of twisted pairs 12 of adjacent cables 10 are as far apart as possible to minimize the capacitance between adjacent cables 10.

The spacer 24 includes structures, such as beads, bands, or strips. The projections 26, 28 can also be referred to as protrusions, ridges, bumps, or extenders.

The conductors 14 of each twisted pair 12 may be made of copper, aluminum, copper-clad steel and plated copper, for example. In addition, the conductor may be made of glass or plastic fiber such that a fiber optic cable is produced in accordance with the principles disclosed. The insulating layer 16 can be made of known materials, such as fluoropolymers, polyvinyl chloride (PVC), polyethylene, polypropylene, or other electrical insulating materials, for example.

The cable core 20 is defined by the plurality of twisted pairs 12. The cable core 20 can include a separator 22, such as a flexible tape strip, to separate the twisted pairs 12. Other types of separators 22, including fillers defining pockets that separate and/or retain each of the twisted pairs 12, can also be used. Further details of example fillers that can be used are described in U.S. patent application Ser. Nos. 10/746,800 and 11/318,350, which are incorporated herein by reference.

Each of the conductors 14 of the individual twisted pairs 12 can be twisted about one another at a continuously changing twist rate, an incremental twist rate, or a constant twist rate. Each of the twist rates of the twisted pairs 12 can further be the same as the twist rates of some or all of the other twisted pairs 12, or different from each of the other twisted pairs 12.

The core 20 of twisted pairs 12 can also be twisted about the central core axis 34. The core 20 can be similarly twisted at any of a continuously changing, incremental, or constant twist rate.

In the manufacture of the present cable 10, two insulated conductors 14 are fed into a pair twisting machine, commonly referred to as a twinner. The twinner twists the two insulated conductors 14 about a longitudinal pair axis at a predetermined twist rate to produce the single twisted pair 12. The twisted pair 12 can be twisted in a right-handed twist direction or a left-handed twist direction.

Figure 3:
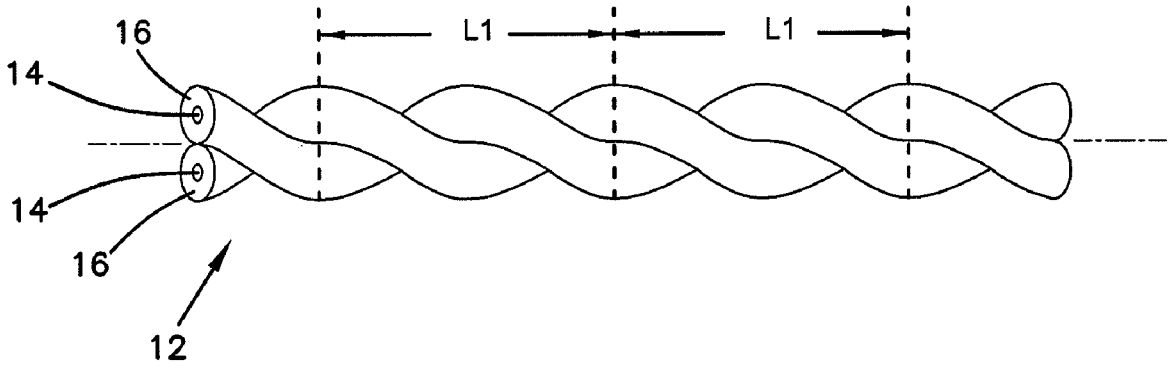
FIG. 3 is a schematic representation of a twisted pair of the cable of FIG. 1.

Referring now to FIG. 3, each of the twisted pairs 12 of the cable 10 is twisted about its longitudinal pair axis at a particular twist rate (only one representative twisted pair 12 shown). The twist rate is the number of twists completed in one unit of length of the twisted pair 12. The twist rate defines a lay length L1 of the twisted pair 12. The lay length L1 is the distance in length of one complete twist cycle. For example, a twisted pair 12 having a twist rate of 0.250 twists per inch has a lay length of 4.0 inches (i.e., the two conductors 14 complete one full twist, peak-to-peak, along a length of 4.0 inches of the twisted pair 12). The lay length L1 of the twisted pairs 12 may be constant, incrementally change, or continuously change.

Figure 4:
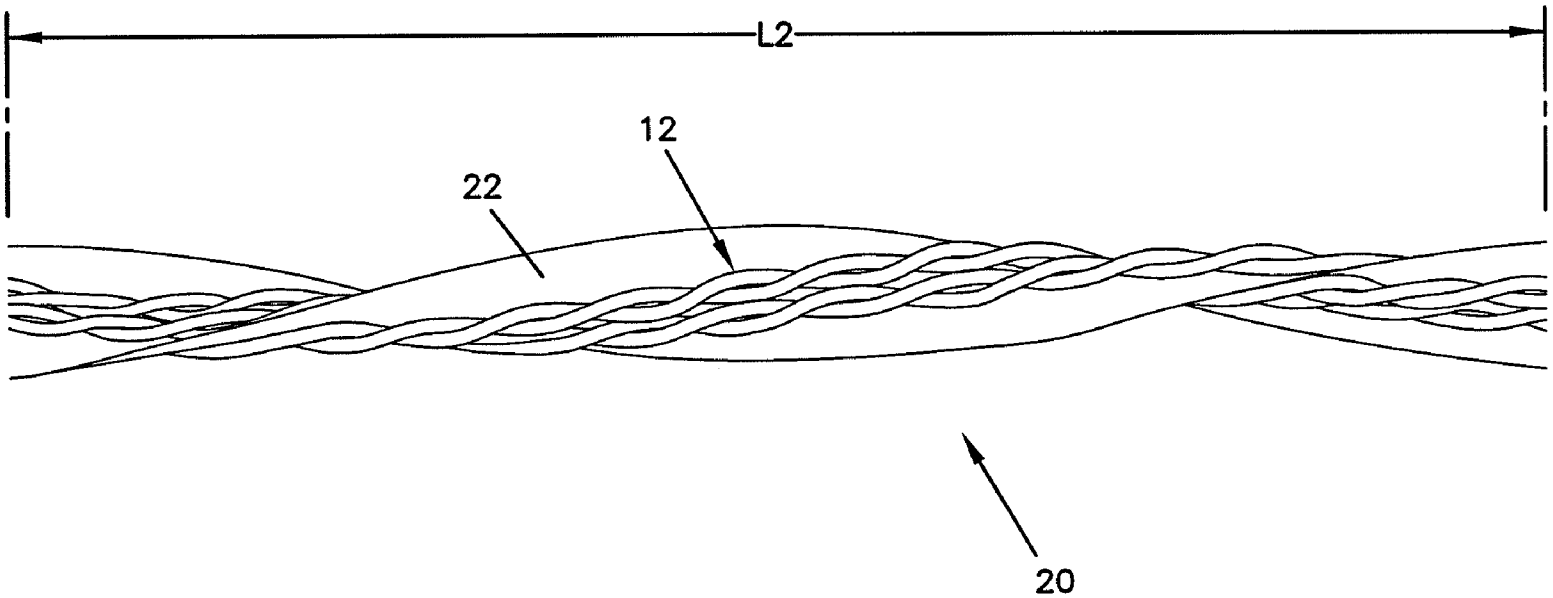
FIG. 4 is a schematic representation of a twisted core of the cable of FIG. 1.

Referring now to FIG. 4, the cable core 20 of the cable 10 is made by twisting together the plurality of twisted pairs 12*a*-12*d* about a central longitudinal core axis 34 at a cable twist rate (only representative of the twisted core 20). The machine producing the twisted cable core 20 is commonly referred to as a cabler. Similar to the twisted pairs 12, the cable twist rate of the cable core 20 is the number of twists completed in one unit of length of the cable 10 or cable core 20. The cable twist rate defines a core 20 or cable lay length L2 of the cable 10. The cable lay length L2 is the distance in length of one complete twist cycle.

In one embodiment, the cabler twists the cable core 20 about a central core axis 34 in the same direction as the direction in which the twisted pairs 12*a*-12*d* are twisted. In another embodiment, the cabler twists the cable core 20 about a central core axis 34 in the opposite direction as the direction in which the twisted pairs 12*a*-12*d* are twisted.

In the illustrated embodiment, the cable 10 is manufactured such that the cable lay length L2 varies between about 1.5 inches and about 2.5 inches. The varying cable lay length L2 of the cable core 20 can vary either incrementally or continuously. In one embodiment, the cable lay length L2 varies randomly along the length of the cable 10. The randomly varying cable lay length L2 is produced by an algorithm program of the cabler machine. In alternative embodiment, the cable lay length L2 is constant.

Referring still to FIGS. 1, 2 and 5-7, the cable 10 includes a jacket 18 and spacer 24 that surrounds the core 20 of twisted pairs 12. In an embodiment, the spacer 24 may be a helical bead. In particular, the jacket 18 includes at least one helical spacer 24. In a preferred embodiment, the jacket 18 includes four spacers 24. However, the jacket 18 may include more than four spacers 24. Preferably, the number of spacers 24 of the jacket 18 is balanced for structural stability and an increased air gap. That is, the jacket 18 preferably has enough spacers 24 to increase spacing between the core 20 and the jacket 18 and between adjacent cables 10; yet still has enough structure to adequately support and retain the core 20 of twisted pairs 12.

Figure 5:
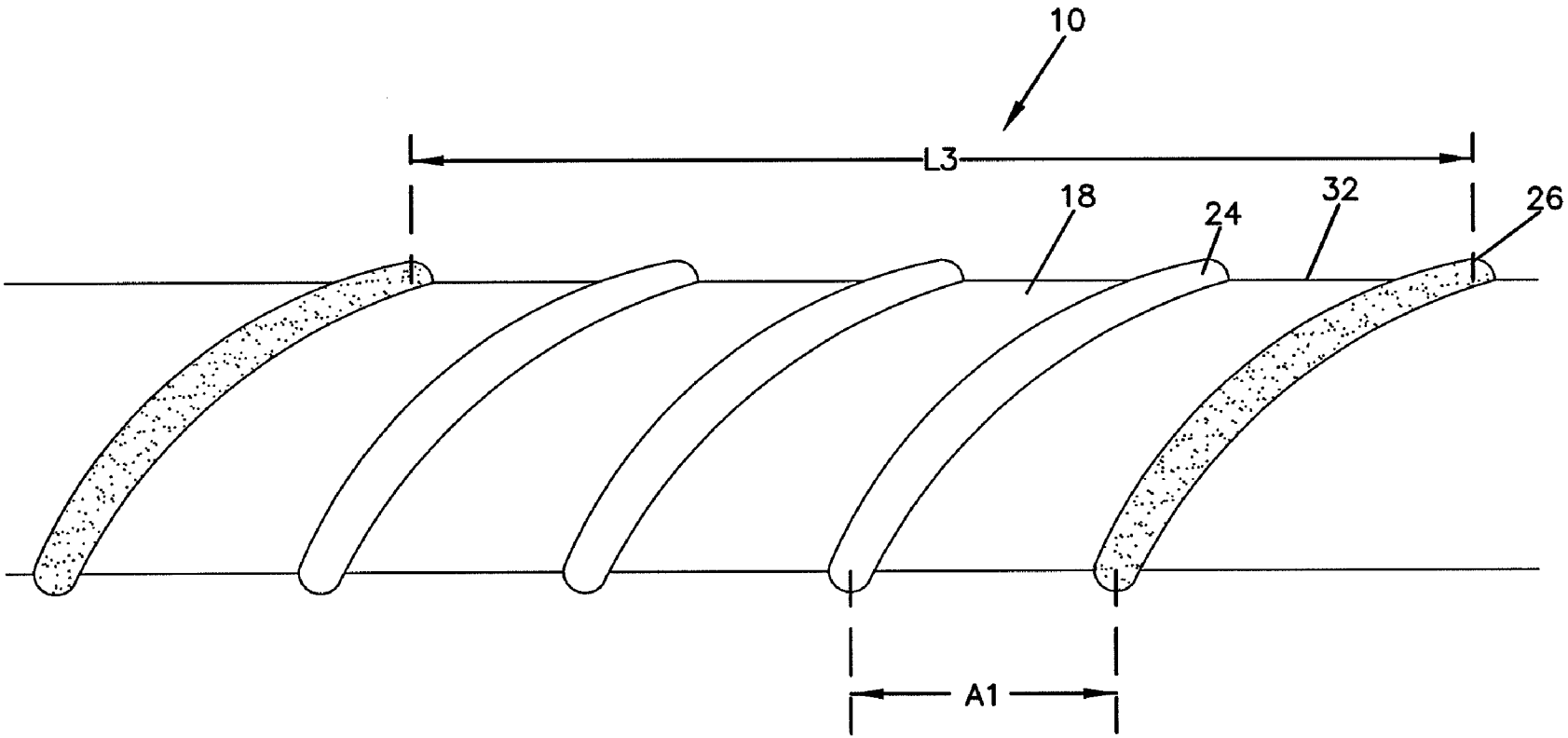
FIG. 5 is schematic representation of helical spacers of a jacket of the cable of FIG. 1.
Figure 6:
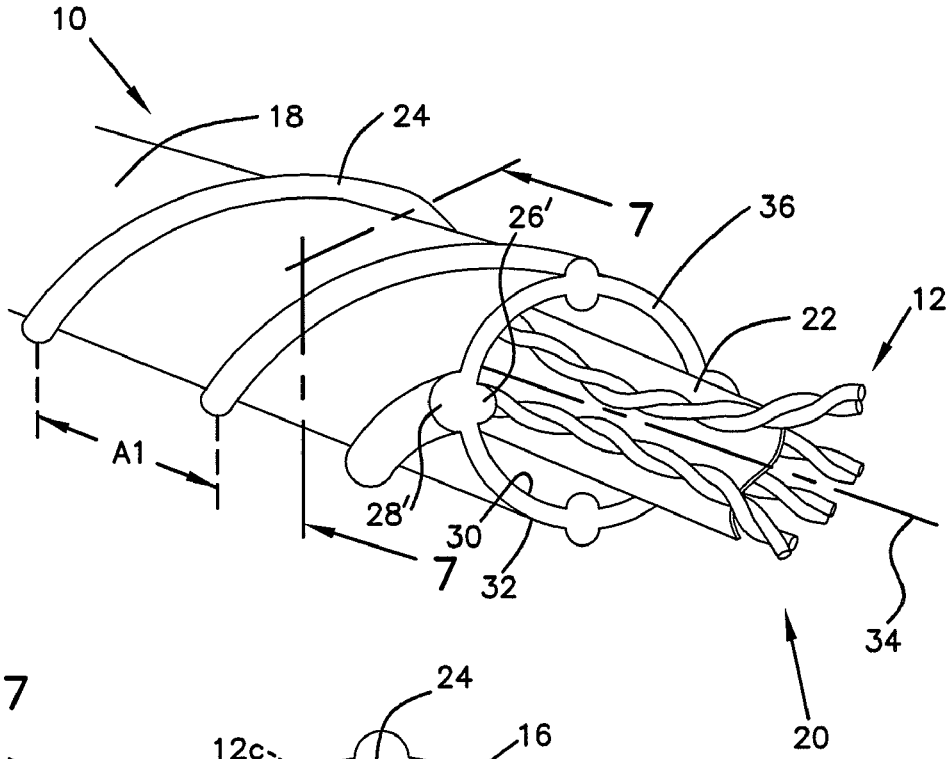
FIG. 6 is a perspective view of one embodiment of a cable according to the principles of the present disclosure.

In one embodiment, the axial spacing A1 of the cable 10 is less than about 2 inches. The axial spacing A1 of the cable 10 is the distance between an outer protrusion 28 and which ever comes first, the next outer protrusion 28 or the same outer protrusion 28 when measuring along the outer surface 32 parallel to the center axis 34, as illustrated in FIGS. 1, 5, and 6. In another embodiment, the axial spacing A1 of the cable 10 is less than about 1 inch. In a further embodiment, the axial spacing A1 of the cable 10 is between about 0.75 to about 1.5 inches. In a preferred embodiment, the axial spacing A1 of the cable 10 is about 1 inch. In another preferred embodiment, the number of spacers 24 and the axial spacing A1 of the cable 10 may be chosen to maximize production speed while maintaining the defined air gap between adjacent cables 10 and between the core 20 and the jacket 18. For instance, the axial spacing A1 of the spacer 24 is chosen to prevent the outer surface 32 of one cable 10 from contacting the outer surface 32 of any adjacent cable 10. Further, the axial spacing A1 may be different than the lay length L2 of the core 20. In one embodiment, the axial spacing A1 may be less than the lay length L2 of the core 20.

Common materials used for jackets include plastic materials, such as fluoropolymers (e.g. ethylenechlorotrifluorothylene (ECTF) and Flurothylenepropylene (FEP)), PVC, polyethylene, fire resistant PVC, low smoke halogen or other electrically insulating materials. Preferably, the material does not propagate flames or generate a significant amount of smoke.

In the illustrated embodiments, the spacer 24 has a generally rounded or circular cross-sectional shape. That is, the spacer 24 is defined by a rounded surface. Other cross-sectional ridge shapes, such as rectangular, square, triangular, or trapezoidal cross-sectional shapes, can also be provided.

Figure 8:
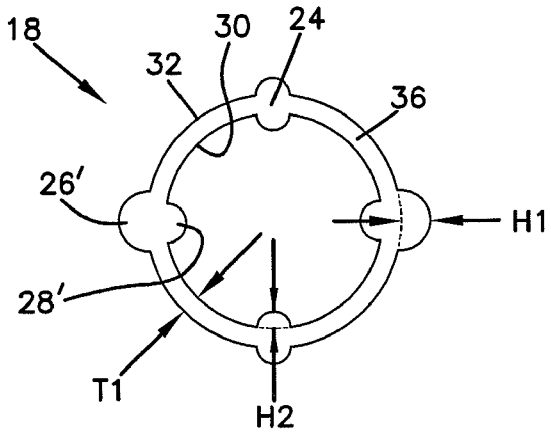
FIG. 8 is a cross-sectional view of a jacket of a cable shown in isolation.

Referring now to FIG. 8, the outer projection 28 of the spacer 24 has a radial height of H1 and the inner projections 26 of the spacer 24 has a radial height of H2. The main wall 36 of the jacket 18 has a thickness of T1. The radial heights H1 and H2 may both be less than about 0.10 inches, less than about 0.050 inches, or less than about 0.025 inches. In a preferred embodiment, the radial heights of H1 and H2 are both between about 0.025 and about 0.050 inches. The thickness T1 of the main wall 36 is preferably between about 0.015 and 0.025 inches.

In one embodiment, all of the projections 26, 28 on the jacket 18 of a cable 10 have substantially the same radial heights H1, H2. In another embodiment, all of the projections 26, 28 on the jacket 18 of a cable 10 have different radial heights H1, H2. In one embodiment, the inner projections 26 have substantially the same radial heights H2. In an alternative embodiment, the inner projections 26 have at least one radial height H2 that differs from the other radial heights H2. In one embodiment, the outer projections 28 have substantially the same radial heights H1. In an alternative embodiment, the outer projections 28 have at least one radial height H1 that differs from the other radial heights H1.

Figure 7:
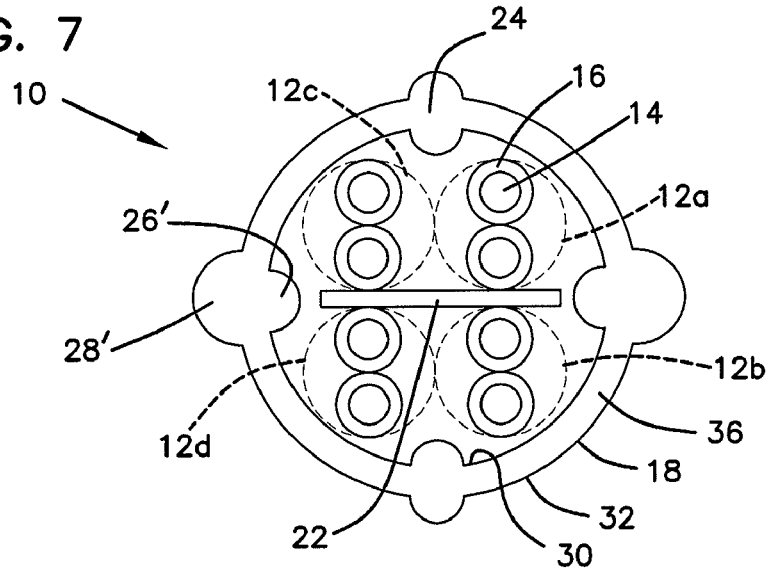
FIG. 7 is a cross-sectional view of the cable of FIG. 6, taken along line 7-7.

In one embodiment, the radial heights H2 of all the inner projections 26' are substantially the same, while at least one radial height H1 differs from the other radial heights H1 of the outer projections 28', as illustrated in FIGS. 6, 7, and 8. The varying heights of the outer projections 28' may help to reduce the occurrence of alien cross talk. In another embodiment, at least one radial height H2 differs from the other radial heights H2 of the inner projections 26 while all the radial heights H1 of the outer projections 28 are substantially the same.

As shown in FIGS. 1, 2, and 5-8, the spacer 24 may be equally positioned about the circumference of the core 20; that is, the spacers 24 may be equally angularly positioned from one another about the central axis 34. In alternative embodiments, the spacers 24 may be angularly positioned in a pattern or more randomly positioned about the inner surface 30 and/or outer surface 32 of the jacket 18. Preferably, the jacket 18 includes two to eight spacers 24 angularly spaced approximately 180 degree to 30 degree from one another about the central axis 34. In one embodiment, four spacers 24 are angularly spaced by about 90 degree from one another about the central axis 34 of the cable 10 as illustrated in FIGS. 1, 2, and 6-8. Other numbers of spacers 24, and spatial arrangements, can be provided.

Further, the helix formed by the spacer 24, illustrated in FIG. 4, also has a lay length L3. The lay length L3 of the spacer 24 is the distance in length of one complete twist cycle of the spacer 24 around the core 20. In one embodiment, the spacer 24 is twisted in the same direction as the core 20 is twisted. In an alternative embodiment, the spacer 24 is twisted in the opposite direction as the core 20 is twisted, which may also help reduce the occurrence of alien cross talk.

In another embodiment, the individual lay length L3 of at least one spacer 24 of the jacket 18 is about 3 inches to about 1 inch. In a further embodiment, the lay length L3 may incrementally change, continuously change, or be constant. A varying lay length L3 may have an average or mean lay length of about 2 inches to about 3 inches. In an embodiment, the lay length L3 of the spacer 24 may vary randomly along the length of the cable 10. In an additional embodiment, the lay lengths L3 of the spacers 24 may vary between cables 10. In another embodiment, the lay length L3 of the spacer 24 is different than the lay length L2 of the core 20, which may further help to reduce the occurrence of alien cross-talk.

The above specification provides a complete description of the present invention. Since many embodiments of the invention can be made without departing from the spirit and scope of the invention, certain aspects of the invention reside in the claims hereinafter appended.

What is claimed is:

1. A cable comprising:

a core including a plurality of twisted pairs, each twisted pair including first and second insulated conductors twisted about one another, the core defining a central axis;

a jacket including a main wall that surrounds the core, the main wall defining a generally circular configuration when the cable is viewed at a transverse cross-section, the main wall including an inner surface and an outer surface, the jacket also including four spacers integrally formed with the main wall and angularly spaced by about 90 degrees from one another about the central axis, each spacer extending helically about the central axis, each spacer including an inner projection that projects radially inwardly from the inner surface of the main wall toward the central axis, the inner projection spacing the core from the inner surface of the main wall such that an air gap is defined between the core and the inner surface of the main wall, each spacer also including an outer projection that projects radially outwardly from the outer surface of the main wall away from the central axis, wherein the inner projection of each spacer is generally radially aligned with the corresponding outer projection of each spacer when the cable is viewed at the transverse cross-section.

2. The cable of claim 1, wherein each spacer is a helical bead.

3. The cable of claim 1, wherein each spacer has a rounded cross-sectional shape.

4. The cable of claim 1, wherein the inner projection and the outer projection has a radial height in the range of about 0.025 to 0.050 inches.

5. The cable of claim 1, wherein each spacer has a radial height of about 0.50 inches to about 1 inch.

6. The cable of claim 1, wherein the spacers are axially separated by an axial spacing of no more than about 1 inch.

7. The cable of claim 1, wherein the spacers each define a helical pattern having a constant lay length.

8. The cable of claim 1, wherein the inner projections have substantially equivalent radial heights.

9. The cable of claim 1, wherein at least one outer projection has a different radial height than an inner projection.

10. The cable of claim 1, wherein at least one outer projection has a radial height that is different than another outer projection.

11. The cable of claim 1, wherein the core has a lay length that is different than a lay length of each spacer.

12. The cable of claim 1, wherein the core is twisted in the opposite direction as each spacer.

13. A cable comprising:

a core including a plurality of twisted pairs, each twisted pair including first and second insulated conductors twisted about one another, the core defining a central axis;

a jacket including a main wall that surrounds the core, the main wall defining a generally circular configuration when the cable is viewed at a transverse cross-section, the main wall including an inner surface and an outer surface, the jacket also including a plurality of spacers integrally formed with the main wall and angularly spaced from one another about the central axis, each spacer extending helically about the central axis, each spacer including an inner projection that projects radially inwardly from the inner surface of the main wall toward the central axis, the inner projection spacing the core from the inner surface of the main wall such that an air gap is defined between the core and the inner surface of the main wall, each spacer also including an outer projection that projects radially outwardly from the outer surface of the main wall away from the central axis, wherein the inner projection of each spacer is generally radially aligned with the corresponding outer projection of each spacer when the cable is viewed at the transverse cross-section, wherein at least one outer projection has a radial height that is different than another outer projection.

14. A cable comprising:

a core including a plurality of twisted pairs, each twisted pair including first and second insulated conductors twisted about one another, the core defining a central axis;

a jacket including a main wall that surrounds the core, the main wall defining a generally circular configuration when the cable is viewed at a transverse cross-section, the main wall including an inner surface and an outer surface, the jacket also including a spacer integrally formed with the main wall, the spacer extending helically about the central axis, the spacer including an inner projection that projects radially inwardly from the inner surface of the main wall toward the central axis, the inner projection spacing the core from the inner surface of the main wall such that an air gap is defined between the core and the inner surface of the main wall, the spacer also including an outer projection that projects radially outwardly from the outer surface of the main wall away from the central axis, wherein the inner projection of the spacer is generally radially aligned with the outer projection of the spacer when the cable is viewed at the transverse cross-section, wherein the core has a lay length that is different than a lay length of the spacer.

15. A cable comprising:

a core including a plurality of twisted pairs, each twisted pair including first and second insulated conductors twisted about one another, the core defining a central axis;

a jacket including a main wall that surrounds the core, the main wall defining a generally circular configuration when the cable is viewed at a transverse cross-section, the main wall including an inner surface and an outer surface, the jacket also including a spacer integrally formed with the main wall, the spacer extending helically about the central axis, the spacer including an inner projection that projects radially inwardly from the inner surface of the main wall toward the central axis, the inner projection spacing the core from the inner surface of the main wall such that an air gap is defined between the core and the inner surface of the main wall, the spacer also including an outer projection that projects radially outwardly from the outer surface of the main wall away from the central axis, wherein the inner projection of the spacer is generally radially aligned with the outer projection of the spacer when the cable is viewed at the transverse cross-section, wherein the core is twisted in the opposite direction as the spacer.

* * * * *